US005263576A

United States Patent [19]

Boreen et al.

[11] Patent Number: 5,263,576

[45] Date of Patent: Nov. 23, 1993

[54] TRANSPARENT STORAGE BOX FOR DISPLAYING TRADING CARDS

[75] Inventors: Richard J. Boreen; Barbara J. Boreen, both of 604 E. Union Ave., Wausau, Wis. 54401; Harper F. Zarker, Jr., Brookfield; David M. Bueschel, Menomonee Falls, both of Wis.

[73] Assignees: Richard J. Boreen; Barbara J. Boreen, both of Wausau, Wis.

[21] Appl. No.: 975,917

[22] Filed: Nov. 12, 1992

[51] Int. Cl.[5] ..... B65D 85/30; B65D 25/00; B65D 21/02; G09F 3/18

[52] U.S. Cl. ..... 206/45.34; 40/152.1; 40/661; 206/455; 220/23.4; 220/346; 220/665

[58] Field of Search ..... 206/444, 455, 45.34; 220/662, 665, 23.4, 345, 346; 40/660, 661, 152, 152.1

[56] References Cited

U.S. PATENT DOCUMENTS

| | | | |
|---|---|---|---|
| 2,548,706 | 4/1951 | Corning | 206/45.34 |
| 3,017,987 | 1/1962 | Moslo . | |
| 3,338,452 | 8/1967 | Oakley et al. | 220/23.4 |
| 3,362,564 | 1/1968 | Mueller | 220/346 |
| 3,577,666 | 5/1971 | Wexler | 206/45.34 X |
| 3,596,391 | 8/1971 | Knight, Jr. | 40/152 |
| 3,630,344 | 12/1971 | Bergh et al. . | |
| 3,703,045 | 11/1972 | Nyman | 40/152 |
| 3,716,936 | 2/1973 | Miller | 40/152 |
| 3,977,112 | 8/1976 | Breer, II | 40/152 |
| 3,992,811 | 11/1976 | Yellin | 220/665 X |
| 4,195,729 | 4/1980 | Macken | 206/45.34 |
| 4,889,254 | 12/1989 | Vola | 220/23.4 |
| 4,979,619 | 12/1990 | Hager . | |
| 5,046,616 | 9/1991 | Makowski et al. . | |

FOREIGN PATENT DOCUMENTS

| | | | |
|---|---|---|---|
| 846602 | 8/1960 | United Kingdom | 220/23.4 |

*Primary Examiner*—Bryon P. Gehman
*Attorney, Agent, or Firm*—Andrus, Sceales, Starke & Sawall

[57] ABSTRACT

A small plastic storage box is particularly adapted for the storage and display of trading cards and includes an open-topped container for edgewise receipt of a stack of cards and a sliding cover to close the box and enclose the cards therein. The container also includes upwardly opening slots around the side walls into which individual trading cards can be inserted edgewise and which are visible from outside the box through the transparent plastic walls. The box also includes a modular construction whereby identical boxes can be interconnected for expanded storage capability.

6 Claims, 2 Drawing Sheets

FIG. 1
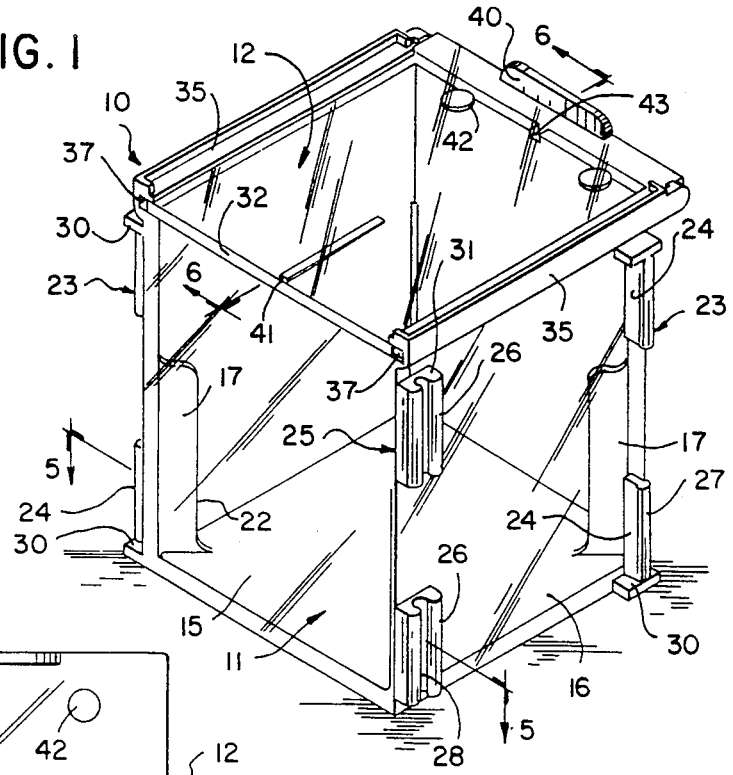
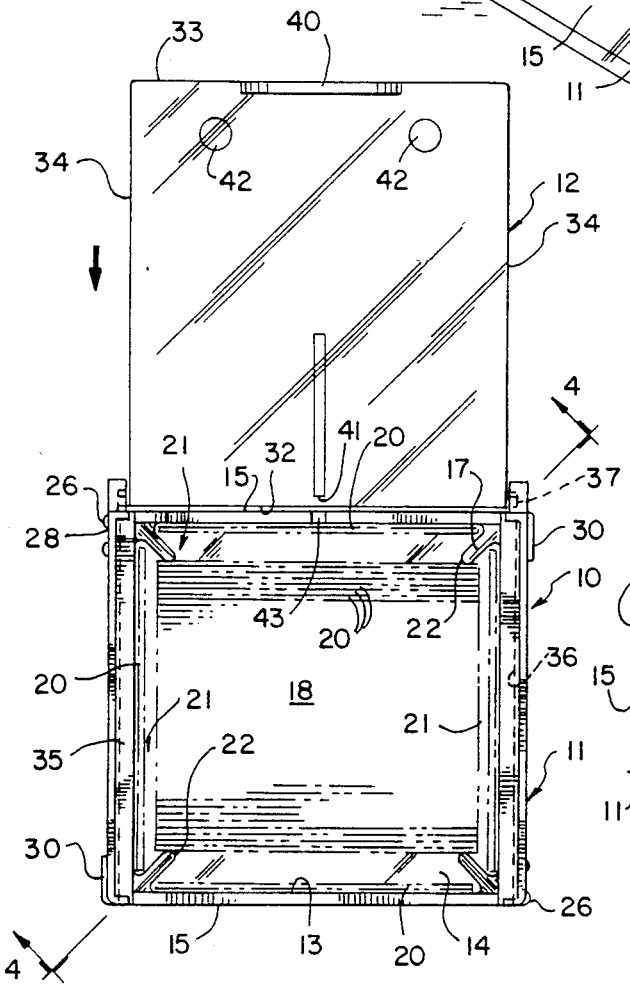
FIG. 2
FIG. 6
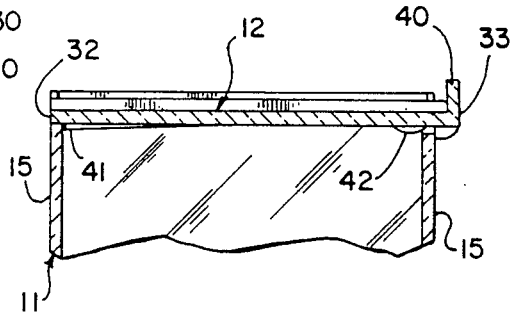

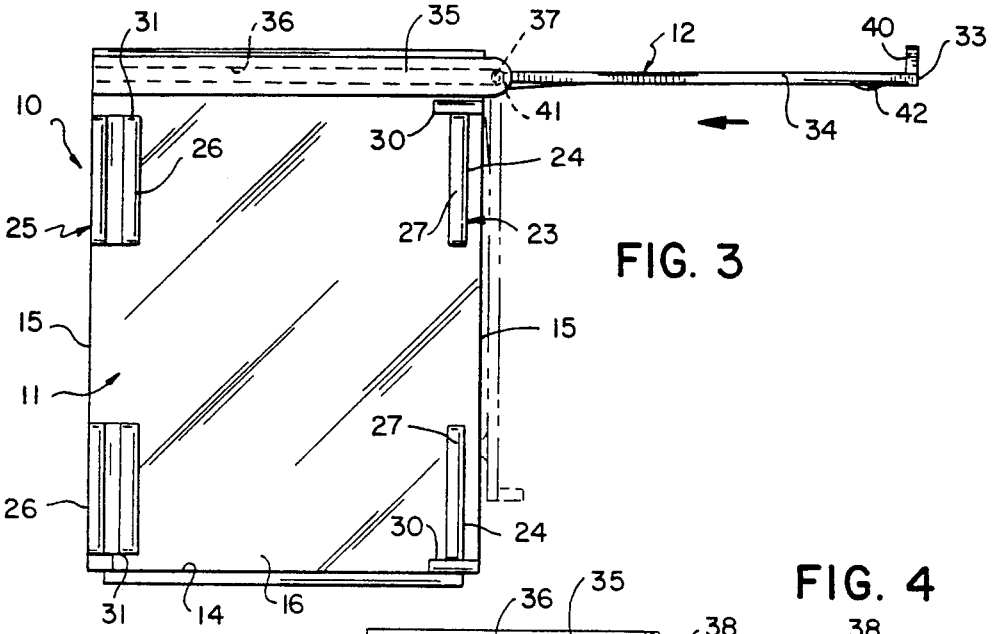
FIG. 3
FIG. 4
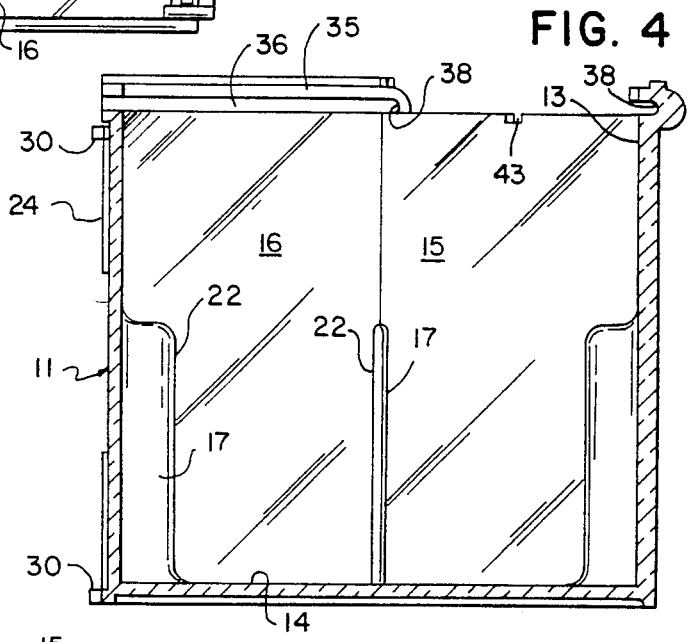
FIG. 5
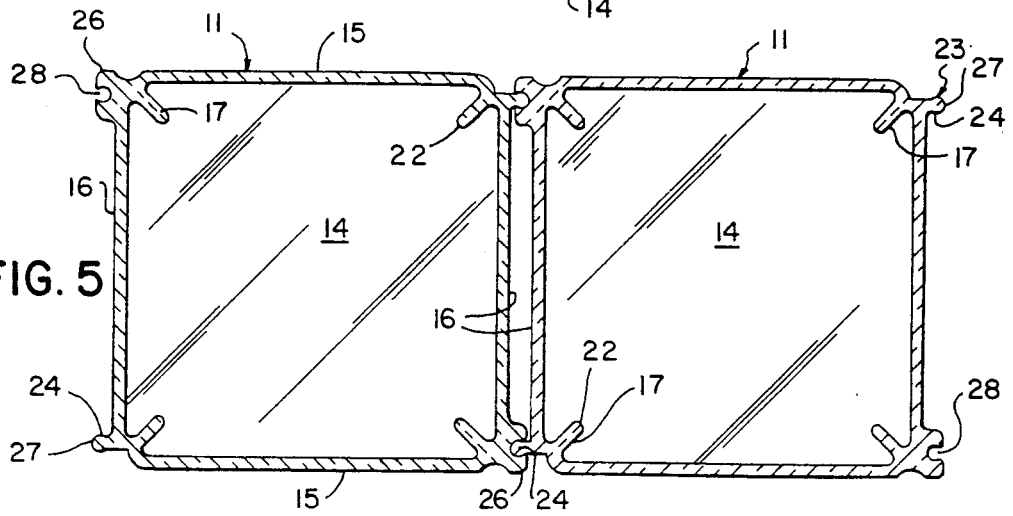

TRANSPARENT STORAGE BOX FOR DISPLAYING TRADING CARDS

BACKGROUND OF THE INVENTION

The subject invention pertains to small plastic storage boxes and, more particularly, to a small transparent plastic box which may be of modular construction and which is particularly adaptable to use for the storage and display of trading cards.

Trading cards covering a wide variety of subjects and topics have been popular for many years. Sports figures, entertainment personalities, cartoon characters, animals, and many other items have been made the subject of trading cards, which may be more accurately described as collector's cards.

Collections of cards covering any one subject or topic may easily run into the thousands and, as a result, storage containers for trading card collections are necessary, not only to help organize and categorize the collection, but to provide protection for the cards as well. Typical trading cards are made of relatively thin paperboard stock, e.g. 0.020 inch (0.5 mm) in thickness, and are usually cut to a size of 2½ inches by 3½ inches (about 6 cm by 9 cm). Typical trading or collecting cards contain a photograph or picture on the front side and printed information about the subject on the back side.

Card collectors have used a variety of enclosures and containers to store and protect cards. Cards may be individually enclosed in transparent plastic sleeves or even laminated in plastic. More typically, sets of related cards are stored in small boxes, usually in a manner in which a stack of cards is inserted edgewise. Thus, the box may be approximately 2½ inches wide, 3½ inches high and long enough to accommodate any desired stack length, for example, 6 to 8 inches (15 to 20 cm) long. A wide variety of small cardboard boxes are available and have been used for such card storage. In order to catalog or keep track of the contents of these boxes, some sort of indicia must be attached or applied to the outside.

Plastic boxes of a wide variety of sizes and shapes are also available for the storage of card collections. However, these containers also typically require the application of some sort of indicia to the outside to identify the contents, if desired.

U.S. Pat. Nos. 4,979,619 and 5,046,616 both show transparent plastic holders for baseball cards or similar trading cards. The earlier patent discloses a card holder for a single card which is laminated or heat sealed to enclose the card. The container in the later patent has multiple compartments for individual cards which are separately openable. Neither of these containers is intended to hold a stack of cards.

SUMMARY OF THE INVENTION

The present invention is directed to a container for trading cards which will accommodate a stack of cards in vertical edgewise orientation and in which individual cards identifying or representative of the cards in the stack can be displayed to provide an indicia of the contents.

In accordance with one embodiment of the present invention, a plastic box for holding and displaying trading cards and the like includes a rectangular open-topped container which is dimensioned to receive and support a stack of cards inserted edgewise. The container also includes means formed integrally with at least one container wall for demountably receiving and holding an individual card which is inserted edgewise and independently of the stack of cards so that the individual card lies against the wall and is visible from outside the box. The container is provided with cover means for closing the container and enclosing both the stack of cards and the individual card.

Slots for receiving and displaying a card are formed integrally with all side and end walls of the container and preferably comprise rib means extending vertically along the walls to define an upwardly opening slot having a length and width when viewed from the top slightly greater, respectively, than the length of one edge and the thickness of the card, and an open side face having a width, when viewed from the side, which is smaller than said length of one edge, whereby the card is retained against the wall. Both the container and cover are preferably made of a hard rigid transparent plastic.

The ribs on the container which form the card-receiving slots may be positioned on the interior of the container to extend laterally in a generally diagonal direction, or they may be positioned on the exterior of the container and extend laterally in a direction toward one another.

In one embodiment, the box is constructed in modular form and includes connector means on the end walls for demountably connecting the box to another box so that the adjacent end walls of the connected boxes are in face-to-face relation. The connector means preferably comprises a vertically extending lip on one vertical edge of each end wall, which lip protrudes perpendicularly outward from the wall, and a vertically extending resilient groove on the other vertical edge of each end wall positioned and dimensioned to receive with a snap or press fit the lip on the adjacent end wall of the other box for connection thereto.

The cover is preferably a flat rectangular shape large enough to span and cover the open top of the container. The cover is slidably attached to the container with opposite edges of the cover adapted to be slidably received in a pair of opposed open slots formed in tracks which extend along the upper edges of one opposite pair of container walls. The opposite edges of the cover may also include a pair of axially aligned oppositely extending pins which are also slidably received in the open slots and cooperate with stop means in the ends of the tracks to retain the cover plate on the container when it is in the open position.

BRIEF DESCRIPTION OF THE DRAWINGS

FIG. 1 is a perspective view of the plastic box of the present invention incorporating a modular construction.

FIG. 2 is a top plan view of the box shown in FIG. 1 with the cover in the open position and showing a stack of trading cards stored therein and individual cards displayed against the end and side walls.

FIG. 3 is a side elevation view of the box shown in FIG. 2.

FIG. 4 is a vertical sectional view taken on line 4—4 of FIG. 2.

FIG. 5 is a horizontal section taken on line 5—5 of FIG. I and showing another identical modular container attached thereto.

FIG. 6 is a partial sectional view taken on line 6—6 of FIG. 1 showing details of the cover.

DETAILED DESCRIPTION OF THE PREFERRED EMBODIMENT

Referring initially to FIGS. 1 and 2, a modular box 10 includes a generally rectangular open-topped container 11 and a cover 12 slidably attached to the top of the container for access to the top opening 13 therein. The container includes a generally flat bottom 14 and integral upstanding side walls 15 and end walls 16. In the embodiment shown in the drawings, the box 10 is of a more or less cubic shape, however, either opposite pair of side walls 15 or end walls 16 could be extended to provide a longer and more truly rectangular shaped box when viewed in plan. Preferably, extension of the box length would be provided by extending the side walls 15.

Referring also to FIGS. 4 and 5, the interior of the container 11 is provided with vertically disposed ribs 17 which extend diagonally into the interior of the container from each of the inside corners. Each of the ribs 17 extends from the container bottom 14 vertically along the corner defined by the intersection of adjacent side and end walls 15 and 16 and terminates about half way up the corner.

The container 11 and cover 12 may be appropriately sized to accommodate storage of a wide variety of goods, but in the preferred embodiment of the invention, the box 10 is adapted to store and display a stack 18 of trading cards 20, which stack is inserted edgewise into the container 11. The container is also adapted to receive and display individual cards 20 through the face of one or more of the walls 15 or 16. A typical trading or collector's card is made of thin card stock and is about 2½ inches wide and about 3½ inches long (approximately 6×9 cm). As is best shown in FIG. 2, each adjacent pair of ribs 17 and the side wall 15 or end wall 16 therebetween form a slot 21 into which an individual card may be easily slid and held vertically against or closely spaced from the wall. With the container 11 constructed of a transparent plastic, such as clear acrylic, the card 20 positioned in a slot 21 is readily visible through the wall from outside the box. The interior vertical edges 22 of the ribs 17 are spaced apart a distance which is less than the width of a card 20, i.e. less than 2½ inches (about 6 cm), so that the displayed card is always retained in position. The remainder of the interior of the container 11 is sized to hold a stack of cards 20 inserted edgewise with the front and back cards in the stack held by the vertical edges 22 of adjacent pairs of ribs 17. In the configuration shown, a stack of approximately 100–125 cards may be held in the box in addition to the four individual cards 20 displayed in the slots 21. The side and end walls 15 and 16 are high enough to accommodate a typical card which is 3½ inches (about 9 cm) in length. Obviously, as desired, if one opposite pair of box walls were lengthened, a stack of cards could be inserted edgewise with the long edges of the cards disposed horizontally. However, with the generally square shape of the container 11 when viewed in plan as in FIG. 2, the stack 18 of cards can be inserted as shown or rotated 90° about a vertical axis and inserted edgewise and held in that position. In either case, the edgewise orientation of the cards 20 makes it easy to access individual cards in the stack, if desired.

The box 10 is preferably made of a modular construction so that multiple boxes can be linked together to provide, for example, common storage for a larger set of cards or the like. Interconnection of modular containers also enhances orderly storage of the boxes. Each container 11 is provided with a set of interlocking connectors on the outside of each of the opposite end walls 16. One vertical edge of each end wall 16 includes a vertically extending lip 23 which, in the embodiment shown, is divided into a pair of vertically spaced lip portions 24. The opposite vertical edge of the end wall 16 is provided with a vertically extending resilient groove 25 which, to accommodate the lip portions 24, is also divided into a pair of vertically spaced groove portions 26. The lip portions 24 include enlarged outer edges 27 and the groove portions 26 have complimentary interior openings 28. The plastic material from which the container is made provides a limited resiliency to the lip portions 24 and groove portions 26 so that two containers 11 can be interconnected by forcing their respective lip portions 24 into the respective groove portions 26 of the adjacent container. As may be best seen in FIGS. 1 and 3, the upper end of the upper lip portion and the lower end of the lower lip portion include integral stop shoulders 30 which engage upper and lower flat surfaces 31 on the groove portions of the container to which they are attached to prevent relative vertical sliding movement between interconnected boxes.

The cover 12 for the box 10 is constructed to slide horizontally back and forth and to be retained on the container in the open as well as the closed position. The cover 12 is of generally flat rectangular construction and sized to completely span the open top 13 of the container 11. The cover includes opposite front and rear edges 32 and 33, respectively, and opposite side edges 34. The upper horizontal edges of the container end walls 16 are provided with integral tracks 35 defining oppositely opening slots 36 which extend along the full lengths of the end wall edges. The side edges 34 of the cover are received in the slots 36 allowing the cover to be slid horizontally back and forth to open and close the container.

Extending outwardly of the opposite ends of the front edge 32 of the cover are a pair of short axially aligned retaining pins 37. The retaining pins also extend perpendicularly from the ends of the opposite side edges 34 and are received in the slots 36 with the cover side edges. The ends of the tracks 35 in the direction of open cover movement are provided with integral stops 38. The stops 38 partially block the slots 36, allowing free sliding movement of the cover side edges 34 therepast, but engaging the retaining pins 37 when the cover is slid to the open position shown in FIGS. 2 and 3. When the cover has been moved horizontally to the fully opened position shown in FIG. 3, the retaining pins 37 also act as pivot pins allowing the cover 12 to be pivoted downwardly and retained in the rest position against the side wall 15, as shown in phantom in FIG. 3.

The cover 12 also includes means for facilitating opening and for retaining the cover in the closed position to prevent inadvertent opening, as by dropping or tipping the box. The top of the cover adjacent the rear edge 33 is provided with a small upstanding handle 40 formed integrally with the cover and allowing it to be easily grasped for opening movement. As may be seen with reference to FIGS. 1, 2, 3 and 6, the underside of the cover is provided with an integral forward stop edge 41 adjacent the front edge 32 and a pair of rear retaining buttons 42 adjacent the rear edge 33. When the cover is in the closed position, the forward stop edge 41 engages the upper inside edge of the side wall 15 and the retaining buttons 42 engage the upper inside edge of the opposite side wall. A small notch 43 centered along the upper edge of the side wall 15 accommodates movement of the stop edge 41 as the cover is moved to the open position. The stop edge 41 prevents overtravel of the cover in the tracks 35 and the retaining buttons 42 require a slight horizontal opening force to be applied in opening the cover, sufficient to cause the buttons to ride over the upper edge of the side wall. Although the tracks 35 could as well be formed along the upper edges of the side walls 15, instead of the end walls 16 as shown, use of the modular construction wherein multiple boxes may be interconnected precludes cover mounting and movement in a direction perpendicular to the end walls.

The slots 21 formed by the ribs 17 and the container wall extending therebetween could be formed as a closed slot by connecting the vertical edges 22 of the ribs with a separate interior wall. Furthermore, if desired, the ribs 17 could be extended vertically the full height of the container so that the modified closed slot would completely enclose a card 20 inserted therein, but still allow the upper edge thereof to be grasped by the user for removal. It is also possible to place the card retaining ribs 17 on the outside of the side walls of the container, thereby enabling a card to be displayed on the outside. A slight increase in interior storage space would also result from placement of the ribs on the exterior of the container.

Various modes of carrying out the present invention are contemplated as being within the scope of the following claims particularly pointing out and distinctly claiming the subject matter which is regarded as the invention.

We claim:

1. A plastic box for holding a stack of a plurality of trading cards and individually displaying at least four trading cards of the type contained in the stack, comprising:

a generally flat bottom floor;

integral transparent side and end walls extending perpendicularly upward from the edges of the bottom floor to form therewith a rectangular open-topped container dimensioned to receive and support a vertical stack of cards inserted edgewise in the vertical direction;

vertically extending ribs in the corners of the container defined by said end and side walls and formed as unitary extensions of said walls, each adjacent pair of ribs and the wall therebetween defining a narrow upwardly opening slot for demountably receiving and holding against one wall an individual card inserted edgewise and independently of the vertical stack of cards so that one face of the individual card is visible from outside the box;

said ribs extending laterally into the container in a generally diagonal direction when viewed from the top of the container, each of said ribs terminating in an inner vertical edge with the vertical edges of each laterally adjacent pair of ribs dimensioned to engage the outside face of one of the front and back cards in a vertical stack of cards inserted edgewise in the vertical direction; and cover means for closing the container and enclosing the stack of cards and the individual cards.

2. The box as set forth in claim 1 including connector means integrally attached to the end walls for demountably connecting the box to another box with adjacent end walls of the connected boxes in face-to-face relation.

3. The plastic box as set forth in claim 1 and further comprising:

connector means formed integrally on said end walls for demountably connecting the box to another identical box with adjacent end walls of the connected boxes in face-to-face relation; and cover means slidably attached to the horizontal upper edges of said pair of end walls for reciprocal opening and closing movement over the open top of the container in a direction perpendicular to the side walls.

4. The modular box as set forth in claim 3 wherein said connector means comprises:

a vertically extending lip on one vertical edge of each end wall, said lip protruding perpendicularly outward from said end wall; and, a vertically extending resilient groove on the other vertical edge of each end wall positioned and dimensioned to receive therein the lip on the adjacent end wall of an identical box for connection thereto.

5. The modular box as set forth in claim 3 wherein said cover means comprises:

a generally flat rectangular cover plate large enough to span the open top of the container;

a pair of axially aligned pins on opposite ends of one edge of the cover plate; and, a pair of tracks having opposed open slots extending along the upper edges of said end walls, said pins and the opposite edges of the cover plate extending perpendicular to said one edge being slidably received in the slots for said opening and closing movement.

6. The modular box as set forth in claim 5 including stop means in the ends of said tracks for engaging said pins to retain the cover plate to the container when the cover plate is slid to its fully open position.

* * * * *